US008823444B2

(12) United States Patent
Fujime et al.

(10) Patent No.: US 8,823,444 B2
(45) Date of Patent: Sep. 2, 2014

(54) REFERENCE VOLTAGE GENERATING CIRCUIT

(71) Applicant: Kabushiki Kaisha Toshiba, Tokyo (JP)

(72) Inventors: Ryuji Fujime, Kanagawa (JP); Masaaki Morikawa, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/791,702

(22) Filed: Mar. 8, 2013

(65) Prior Publication Data

US 2014/0084989 A1 Mar. 27, 2014

(30) Foreign Application Priority Data

Sep. 24, 2012 (JP) ..... 2012-209391

(51) Int. Cl.
*G05F 1/10* (2006.01)

(52) U.S. Cl.
USPC ..... 327/539; 327/540; 327/542; 323/313

(58) Field of Classification Search
USPC ..... 327/512, 513, 538–543; 323/313, 314
See application file for complete search history.

(56) References Cited

U.S. PATENT DOCUMENTS 3,887,863 A 6/1975 Brokaw
4,250,445 A * 2/1981 Brokaw ..... 323/313
5,352,973 A * 10/1994 Audy ..... 323/313
5,767,664 A 6/1998 Price

* cited by examiner

*Primary Examiner* — William Hernandez
(74) *Attorney, Agent, or Firm* — Patterson & Sheridan, LLP

(57) ABSTRACT

A reference voltage generating circuit comprises a pair of variable resistors connected to a pair of bipolar transistors. A differential amplifier amplifies the band gap voltage difference between the bipolar transistors and outputs a reference voltage to an output terminal. An output stage resistor is connected to the output terminal and a resistance dividing circuit. The generating circuit includes temperature compensating circuits that receive tap voltages from resistance dividing circuit and a current proportional to the temperature, then output correction currents. The generating circuit additionally includes a current mirror circuit that outputs a mirror current depending on each correction current. The reference voltage generating circuit thus corrects the temperature dependence of the reference voltage.

20 Claims, 5 Drawing Sheets

REFERENCE VOLTAGE GENERATING CIRCUIT

CROSS-REFERENCE TO RELATED APPLICATION

This application is based upon and claims the benefit of priority from Japanese Patent Application No. 2012-209391, filed Sep. 24, 2012; the entire contents of which are incorporated herein by reference.

FIELD

Embodiments described herein relate generally to a reference voltage generating circuit.

BACKGROUND

An integrated circuit (IC) for battery monitoring requires a reference voltage. A reference voltage generating circuit using a Brokaw cell is a known circuit that uses the band gap voltage of a coupled transistor to generate a reference voltage. In this circuit, however, the temperature dependence of the reference voltage is shaped like a convex parabola, which is undesirable. Therefore, a band gap voltage reference circuit that generates a flat reference voltage over a wide temperature range by adopting a temperature compensating circuit that corrects the temperature dependence in low-temperature region and high-temperature region has been previously developed.

That is, a Brokaw cell in this reference voltage generating circuit is equipped with two bipolar transistors Q1 and Q2 having emitter areas with an area ratio of A:1 (where A is an integer value) and an operational amplifier that differentially amplifies the voltage between the collectors of the transistors Q1 and Q2. The Brokaw cell is also equipped with a feedback loop that feeds back the amplified output of the operational amplifier to the bases of the transistors Q1 and Q2. The Brokaw cell also includes two resistors R1 and R2 connected in series between the emitter of the transistor Q1 and the ground potential. In this Brokaw cell, the voltage VBE between the base and emitter of the transistor Q2 has a negative temperature coefficient that decreases with respect to the temperature rise. Also, a voltage having a positive temperature coefficient that increases with respect to temperature rise is generated across the resistor R2. The two voltages having the positive and negative temperature coefficients act on the voltage at the connection point of resistors R1 and R2.

A temperature compensating circuit may include a first differential amplifier that compensates for the temperature dependence in the low-temperature region and a second differential amplifier that compensates for the temperature dependence in the high-temperature region. Current from constant current sources are supplied to these differential amplifiers. The output currents are supplied to a mirror circuit, whose output corrects the output voltage of the Brokaw cell.

In the prior art, however, there are usually variations in the characteristics of the elements, such as the transistor pair Q1 and Q2 of the Brokaw cell, and the resistors R1 and R2. The temperature dependence of the output reference voltage, which should be flat with respect to temperature variation, tends to tilt with a positive or negative slope due to the variations in the collector currents of the transistors Q1 and Q2. The value of the supplied correction current also varies due to the variations in the elements, making a reference voltage generating circuit unable to output a constant reference voltage with high accuracy.

More specifically, due to the variations in the elements during fabrication, the contribution of the voltage having the positive temperature coefficient present at the connection point of the resistors R1 and R2 or the contribution of the base-emitter voltage of transistor pair Q1 and Q2 may become too strong or too weak relative to the negative temperature coefficient, and the overall temperature characteristic (dependence) of the reference voltage will therefore tend to have a positive or negative slope. The reference voltage may also vary due to unintended variations in the current sources that supply, notionally, constant currents to the first and second differential amplifiers of the temperature compensating circuit.

DETAILED DESCRIPTION

In general, a reference voltage generating circuit will be explained with reference to FIGS. 1 to 5. The same parts in the figures are represented by the same respective symbols and will not be explained repeatedly.

The present disclosure describes a reference voltage generating circuit which can supply a reference voltage at a more constant voltage with respect to temperature variations.

An example embodiment of a reference voltage generating circuit includes a pair of bipolar transistors (first and second bipolar transistors) connected to a pair of variable resistors (first and second variable resistors). The bipolar transistors have collector electrodes and emitter electrodes connected in parallel between a power supply potential and a ground potential and base electrodes connected commonly and having different emitter current densities. The generating circuit includes a first differential amplifier that receives voltages from the collectors of the bipolar transistors and amplifies the difference and output a reference voltage.

The reference voltage generating circuit further includes an output stage resistor and a resistance dividing circuit that are connected in series between a reference voltage output terminal of the voltage generator and the ground potential and include a connection point to which the base electrode of the pair of bipolar transistors are commonly connected.

The temperature variation (dependence) of the reference voltage can be altered by a low-temperature region temperature compensating circuit that includes a second differential amplifier that has two input terminals receiving input of a first tap voltage from the resistance dividing circuit and a temperature proportional voltage from the voltage generator, receives current from a first constant current source, and outputs a first correction current corresponding to the difference between the potentials supplied to the two input terminals. The temperature variation (dependence) of the reference voltage can also be altered by a high-temperature region temperature compensating circuit including a third differential amplifier that has two input terminals receiving input of a second tap voltage from the resistance dividing circuit and the temperature proportional voltage, receives current from a second constant current source, and outputs a second correction current corresponding to the difference between the potentials supplied to the two input terminals.

The reference voltage generator circuit may include a current mirror circuit that outputs a mirror current based on the first and second correction currents between the output stage resistor and the resistance dividing circuit. The temperature dependence of the reference voltage may be corrected by applying the reference voltage to the commonly connected base electrode of the pair of bipolar transistors via the output stage resistor.

First Embodiment

Figure 1:
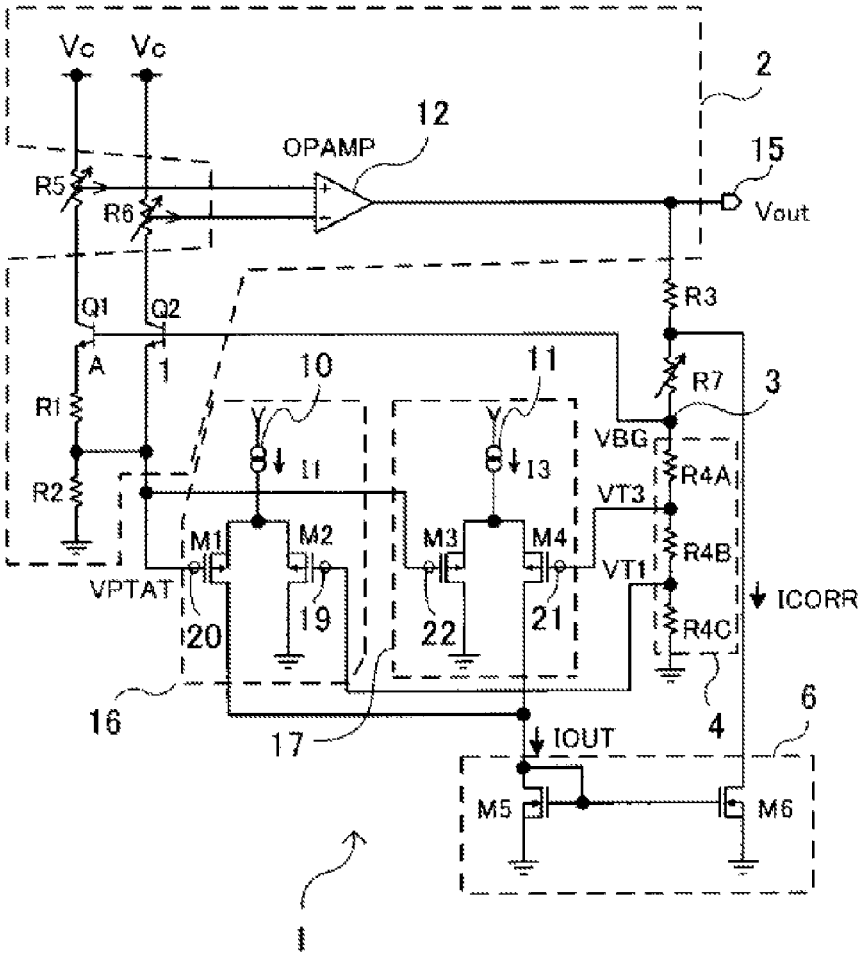
FIG. 1 is a circuit diagram of a reference voltage generating circuit according to a first embodiment.

FIG. 1 shows a circuit diagram of the reference voltage generating circuit according to the first embodiment. A reference voltage generating circuit 1 is a semiconductor integrated circuit used, for example, as in an integrated circuit (IC) for battery monitoring. The reference voltage generating circuit 1 includes a voltage generator 2, an output stage resistor R3, a resistance dividing circuit 4, a low-temperature region temperature compensating circuit 16, a high-temperature region temperature compensating circuit 17, a current mirror circuit 6. The voltage generator 2 has a pair of the bipolar transistors Q1, Q2, the first and the second resistors R1, R2, two variable resistors R5, R6, and an operational amplifier 12 (first differential amplifier). It outputs the differentially amplified voltage Vout (reference voltage) at a voltage level between the band gap voltages of the bipolar transistors Q1, Q2. The output stage resistor R3 and the resistance dividing circuit 4 are connected in series between a reference voltage output terminal 15 of the voltage generator 2 and the ground potential.

The low-temperature region temperature compensating circuit 16 outputs a first correction current corresponding to a potential difference between a first tap voltage VT1 from the resistance dividing circuit 4 and the temperature proportional voltage VPTAT (proportional to absolute temperature) generated by the second resistor of the voltage generator 2 based on a first constant current source 10. The high-temperature region temperature compensating circuit 17 outputs a second correction current corresponding to the potential difference between a second tap voltage VT3 from the resistance dividing circuit 4 and temperature proportional voltage VPTAT based on a second constant current source 11. The second tap voltage VT3 is different from the first tap voltage VT1. The current mirror circuit 6 generates a mirror current Icorr depending on correction currents Iout from the low-temperature region temperature compensating circuit 16 and the high-temperature region temperature compensating circuit 17. The reference voltage generating circuit 1 corrects the temperature dependence of a reference voltage Vout by extracting mirror current Icorr via the output stage resistor R3.

The bipolar transistors Q1 and Q2 of the voltage generator 2 have emitter areas with an area ratio of A (integer):1 and have different emitter current densities. The pair of bipolar transistors Q1 and Q2 has their collector electrodes and emitter electrodes connected in parallel between DC power supply potential Vc and the ground potential and their base electrodes connected to each other. The first resistor R1 is connected between the ground potential and the emitter electrode of the transistor Q1 with higher current density out of the pair of bipolar transistors Q1 and Q2. The second resistor R2 is connected in series to the first resistor R1 and is connected between the emitter electrode of the transistor Q2 and the ground potential. The first variable resistor R5 and the second variable resistor R6 are connected between the DC power supply potential Vc and the collector electrodes of the bipolar transistors Q1, Q2. The operational amplifier 12 receives input of the voltages generated across the first and the second variable resistors R5, R6, amplifies the difference between the band gap voltages of the bipolar transistors Q1 and Q2, and outputs the result. The output voltage from the operation amplifier 12 is fed back to the commonly connected base electrodes of the bipolar transistors Q1 and Q2. The output voltage of the operational amplifier 12 that is fed back is also output as the reference voltage through the reference voltage output terminal 15.

A forward bias is applied between the base and emitter of the transistors Q1 and Q2. The base-emitter voltage of the transistor Q1 or the base-emitter voltage of the transistor Q2 has a negative temperature coefficient. The negative temperature coefficient means that the base-emitter voltage drops as an absolute temperature rises (CTAT [complementary to absolute temperature]). On the other hand, each collector electrode of the transistors Q1 and Q2 is maintained to the common voltage by means of virtual short circuit using the operational amplifier 12. A voltage signal having a positive temperature coefficient is fed back to the bases of the transistors Q1 and Q2 via the output stage resistor R3. The transistors Q1 and Q2 operating at different collector current densities with respect to each base-emitter voltage operate at collector currents that are proportional to the absolute temperature. A voltage having a positive temperature coefficient that increases with respect to temperature rise is generated across the resistor R2. Two voltages having positive and negative temperature coefficients act on the voltage at the connection point of the resistors R1 and R2. When the collector current of the transistor Q1 is greater than that of the transistor Q2. The collector current of the transistor Q1 flows into the resistors R1 and R2, and the amplified output voltage having a positive temperature coefficient rises because the voltage with the positive temperature coefficient becomes more dominant than the voltage with the negative temperature coefficient. The two voltages having the positive and negative temperature coefficients are present as voltage VPTAT at the connection point of the resistors R1 and R2.

The output stage resistor R3 is used to extract the reference voltage Vout output from the operational amplifier 12. The resistance dividing circuit 4 has multiple resistors R4A, R4B and R4C connected in series. The commonly connected base electrode of the bipolar transistors Q1 and Q2 is connected to a connection point 3 between the output stage resistor R3 and the resistance dividing circuit 4. The voltage VBG is fed back to the base electrodes. The voltage VBG has a value corresponding to the band gap voltage. The voltage VBG has the highest stability among the voltages in the reference voltage generating circuit 1.

It is also possible to connect a variable resistor R7 (third variable resistor) between the output stage resistor R3 and the resistance dividing circuit 4. The absolute value of the reference voltage Vout is adjusted when the resistance value of the variable resistor R7 is varied. The variable resistor R7 can be adjusted during fabrication, inspection, or test of the reference voltage generating circuit 1. After adjustment, the resistance of variable resistor R7 maintained at the same resistance value.

The low-temperature region temperature compensating circuit 16 is equipped with differential transistor pair M1 and M2 (second differential amplifier). The temperature proportional voltage VPTAT is supplied to an input terminal 29 of the transistor M1, and the first tap voltage VT1 is supplied to an input terminal 19 of the transistor M2. The current from the constant current source 10 is supplied to the differential transistor pair M1 and M2, and a correction current is output corresponding to the potential difference supplied to the input terminals 20 and 19. Also, the high-temperature region temperature compensating circuit 17 is equipped with transistor pair M3 and M4 (third differential amplifier). The temperature proportional voltage VPTAT is supplied to an input terminal 22 of the transistor M3, and the second tap voltage VT3 is supplied to an input terminal 21 of the transistor M4. The differential transistor pair M3 and M4 receives the current supplied from the constant current source 11 and outputs a correction current corresponding to the potential difference supplied to the input terminals 22 and 21. MOS transistors are used for the transistors M1, M2, M3 and M4.

Also, the threshold temperature on the low-temperature side for the differential transistor pair M1 and M2 to turn on the constant current source 10 is determined by the following parameters. These parameters are the first tap voltage VT1, voltage signal VPTAT, and the on-threshold voltages of the gates of the transistors M1 and M2. The differential transistor pair M1 and M2 carries out correction by increasing reference voltage Vout depending on the output of the mirror current Icorr in the low-temperature region to raise the downward curve of the temperature dependence curve in the low-temperature region. Also, the threshold temperature on the high-temperature side for differential transistor pair M3 and M4 to turn on the constant current source 11 is determined by the following parameters. These parameters are the tap voltage VT3, voltage signal VPTAT, and the on threshold voltages for the gates of transistors M3 and M4. The differential transistor pair M3 and M4 carries out correction by increasing reference voltage Vout depending on the output of the mirror current Icorr in the high-temperature region to raise the downward curvature of the temperature dependence curve in the high-temperature region.

The correction currents are input in parallel from the low-temperature region temperature compensating circuit 16 and the high-temperature region temperature compensating circuit 17 into the current mirror circuit 6. The current mirror circuit 6 is equipped with transistor M5 having its drain receiving the combined correction current Iout from the low-temperature region temperature compensating circuit 16 and the high-temperature region temperature compensating circuit 17 and its gate connected to its drain and transistor M6 having its gate connected commonly to the gate of the transistor M5 and a drain to which mirror current Icorr is supplied. The correction current Iout is duplicated by the transistors M5 and M6, and a mirror current having a value of any magnification of the correction current value is extracted as mirror current Icorr. MOS transistors are used for the transistors M5 and M6.

Figure 2A:
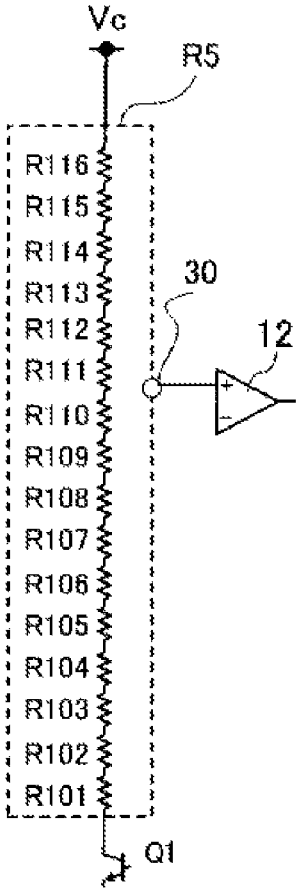
FIGS. 2A and 2B are diagrams illustrating a configuration example of first and second variable resistors of the reference voltage generating circuit according to the first embodiment.
Figure 2B:
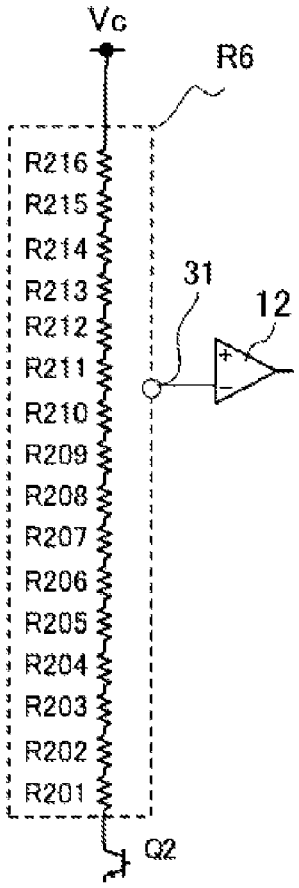

Each of the variable resistors R5 and R6 has multiple resistors connected in series. FIG. 2A shows a configuration example of the variable resistor R5. FIG. 2B shows a configuration example of the variable resistor R6. Each of the variable resistors R5 and R6 shown in FIGS. 2A and 2B has 16 resistors. The variable resistor R5 outputs the voltage extracted from any connection point to a terminal 30. The variable resistor R6 outputs the voltage extracted from any connection point to a terminal 31. The terminal 30 is connected to the non-inverting input terminal (+) of the operational amplifier 12, while the terminal 31 is connected to the inverting input terminal (−). The variable resistors R5 and R6 can adjust their resistance values independently from each other. By adjusting each resistance value, the variable resistors R5 and R6 trim the tilted temperature dependence of the reference voltage Vout.

A reference power supply device with expanded flat temperature dependence is obtained by using the reference voltage generating circuit 1.

Figure 3:
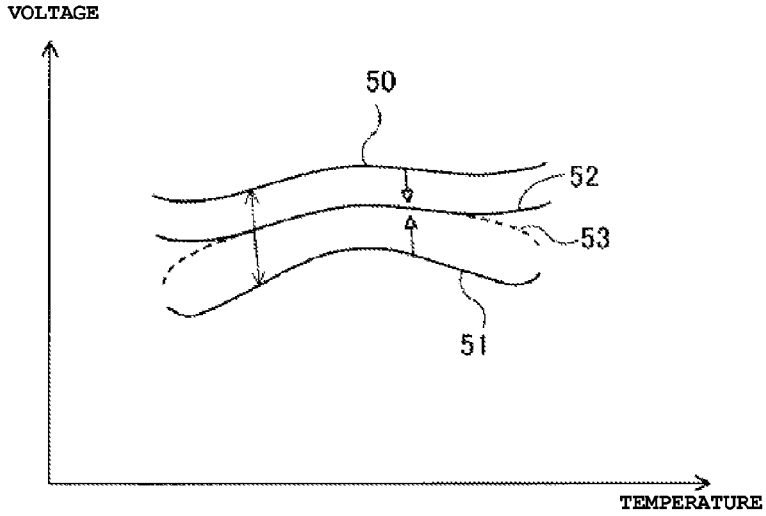
FIG. 3 is a diagram illustrating an example of temperature dependence of the reference voltage before temperature compensation generated by the reference voltage generating circuit according to the first embodiment.

FIG. 3 shows a diagram illustrating an example of the temperature dependence of the reference voltage Vout before low-temperature/high-temperature compensation by the reference voltage generating circuit 1 according to the first embodiment. The abscissa represents the absolute temperature, while the ordinate represents the reference voltage Vout. Characteristic curve 53 shows the temperature dependence of the reference voltage Vout when the low-temperature region temperature compensating circuit 16 and the high-temperature region temperature compensating circuit 17 are absent. This characteristic curve 53 has the shape of a convex parabola. The temperature dependence curves downwards in the low-temperature region and the high-temperature region. On the other hand, the characteristic curve 52 shows the temperature dependence of the reference voltage Vout subjected to temperature correction at low temperature and high temperature by the low-temperature region temperature compensating circuit 16 and the high-temperature region temperature compensating circuit 17. The downward curvature of the characteristic curve 53 at low temperature is raised by the low-temperature region temperature compensating circuit 16, while the downward curvature of the characteristic curve 53 at high temperature is raised by the high-temperature region temperature compensating circuit 17.

However, as described above, in the reference voltage generating circuit in which the voltage between the collectors of the transistors Q1, Q2 is directly amplified by the operational amplifier 12, the temperature dependence of reference voltage Vout, which should ideally be flat, tilts positively or negatively.

Figure 4:
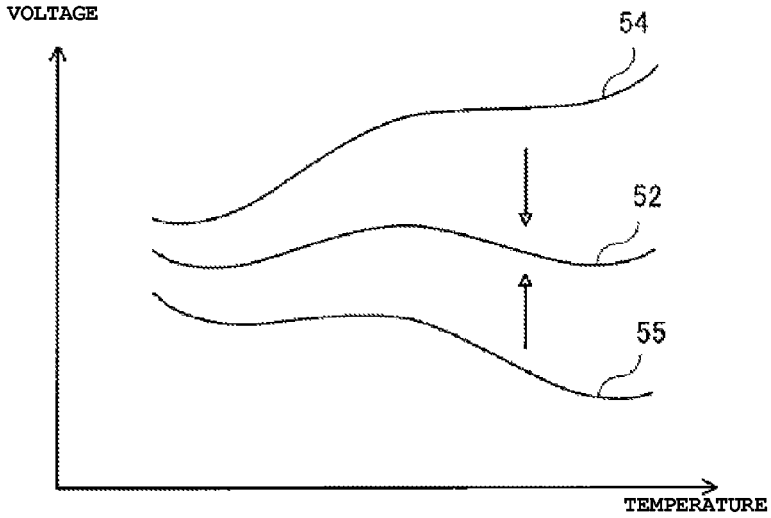
FIG. 4 is a diagram illustrating an example of the temperature dependence of each reference voltage before and after slope correction generated by the reference voltage generating circuit according to the first embodiment.

FIG. 4 shows a diagram illustrating an example of the temperature dependence of each reference voltage Vout before and after slope correction by the reference voltage generating circuit 1 according to the first embodiment. Characteristic curves 54 and 55 represent the temperature dependences including secondary nonlinear components. The secondary nonlinear component is a nonlinear component formed by the squared term of absolute temperature T. The characteristic curve 54 tilts to the upper right side since the contribution by the positive temperature coefficient among the positive and negative temperature dependences is more significant than the contribution by the negative temperature coefficient. The characteristic curve 55 tilts to the lower right side since the contribution by the negative temperature coefficient is more significant than the contribution by the positive temperature coefficient. The characteristic curves 54 and 55 show the temperature dependence of reference voltage Vout when no adjustment is made by using the variable resistors R5 and R6.

In the following, adjustment of the slope of the temperature dependence will be explained. The adjustment of the variable resistors R5, R6 is conducted by connecting a measurement device for voltage monitoring (not shown in the figure) to the reference voltage generating circuit 1. The variable resistors R5, R6 are changed to various values during the adjustment test, and the corresponding reference voltage Vout is recorded.

First, the reference voltage generating circuit 1 is set to a low temperature. The connection points of the resistors connected in series to the terminals 30 and 31 of the variable resistors R5 and R6 are switched. For example, the terminal of a resistor R116 on a Vc side is connected to the terminal 30, and the terminal of a resistor R216 on the Vc side is connected to the terminal 31. The reference voltage Vout is measured by a voltage measurement device. Then, the terminal of the resistor R116 on the Vc side is connected to the terminal 30, and the connection point of the resistors R216, R215 is connected to the terminal 31. The reference voltage Vout is measured again. The measurement can be carried out as the combination of the connection points is switched and varied. Since each variable resistor in FIGS. 2A and 2B has 16 connection points, a total of 256 reference voltages Vout are measured. As a result, sample values VL1, VL2, . . . , VL256 of reference voltage Vout are obtained in the low-temperature test.

Then, the reference voltage generating circuit 1 is set to a high temperature, and the combination of the connection points is switched and reference voltage Vout is measured in the same way. As a result, sample values VH1, VH2, . . . , VH256 of the reference voltage Vout are obtained in the high-temperature test.

Then, the differences for the pairs of different reference voltages Vout, that is, difference of VL1−VH1, difference of VL2−VH2, . . . , difference of VL256−VH256 are derived. As a result, for example, 256 types of voltage differences expressed in mV are obtained. The resistance value pair of the variable resistors R5 and R6 corresponding to the minimum difference value among the obtained difference values is selected and set. When the variable resistors R5 and R6 are set to the resistance values that minimize the measured voltage difference, the slope of the reference voltage Vout as a function of temperature will be minimized and approach zero.

Also, the reference voltage generating circuit 1 is designed such that appropriate feedback is carried out to equalize the currents flowing through the resistors R5 and R6 so that the slope of Vout at that time becomes zero. When the voltage generated across the resistor R2 has a positive temperature slope with respect to the base-emitter voltage VBE of the transistor Q2 that has a negative temperature slope, the temperature slopes are canceled out. However, when the reference voltage generating circuit 1 is fabricated as an IC, since there are generally variations, such as a mismatch of between resistors R5 and R6, a mismatch between resistors R1 and R2, a mismatch of the transistors Q1 and Q2, and the offset voltage of the operational amplifier 12, the slope of reference voltage Vout has a distribution. In this embodiment, this is corrected by adjusting the values of the variable resistors R5 and R6.

For example, when the reference voltage Vout has a strong positive temperature slope, if the value of the variable resistor R5 is increased, the voltage generated across the resistor R2 is reduced. The proportion of the voltage having a positive temperature slope among the reference voltage Vout is reduced, and the overall slope can be adjusted to nearly zero. If the value of the variable resistor R6 is reduced, the value of base-emitter voltage VBE of the transistor Q2 is increased. The proportion of the voltage having a negative temperature slope among reference voltage Vout increases, and the overall slope of the reference voltage Vout can be adjusted to nearly zero.

On the other hand, when the reference voltage Vout has a strong negative temperature slope, if the value of the variable resistor R5 is reduced, the voltage generated across the resistor R2 is increased. The proportion of the voltage having a positive temperature slope among the reference voltage Vout is increased so that the overall slope of the reference voltage Vout can be adjusted to nearly zero.

If the value of the variable resistor R6 is increased, the value of the base-emitter voltage VBE of the transistor Q2 is reduced. The proportion of the voltage having a negative temperature slope included in the reference voltage Vout is reduced so that the overall slope can be adjusted to nearly zero.

When the values of the variable resistors R5 and R6 are adjusted as described above, the proportion of the voltage having the positive temperature slope and the proportion of the voltage having the negative temperature slope among the reference voltage Vout are changed so that the temperature slope can be adjusted to zero. Device operation regarding this point has been confirmed by means of simulation and also with an actual IC prototype device incorporating the reference voltage generating circuit 1.

FIG. 4 shows the characteristic curve 52 of the reference voltage Vout after adjustment. The adjustment of the variable resistors R5 and R6 becomes the temperature slope trimming function. The voltage difference between the high-temperature output voltage and the low-temperature output voltage is changed. The voltage difference of the previous amplification stage of the operational amplifier 12 is shifted as a result of the adjustment of the variable resistors R5 and R6. The reference voltage generating circuit 1 can obtain the reference voltage Vout having the temperature dependence expressed by the characteristic curve 52.

The reference voltage generating circuit 1 according to this embodiment also has the variable resistor R7 that can be adjusted by means of trimming in the output gain stage. The adjustment of the variable resistor R7 becomes the absolute value trimming function. The level of the reference voltage Vout can be finely adjusted. The characteristic curve 52 can be restrained within the constant voltage error ranges 50 and 51 shown in FIG. 3. The slope of reference voltage Vout can be flattened as in the characteristic curve 52 in FIG. 4.

As described above, the slope of the temperature dependence can be correctly flattened using the function for trimming the slope of the temperature dependence using the reference voltage generating circuit 1. Also, when the characteristic curve 52 is adjusted within a prescribed range depending on the absolute value trimming function, a reference voltage can thus be generated with high accuracy. The reference voltage generating circuit 1 having the function of the correcting curvature at high temperature and low temperature, the function for trimming the slope of the temperature dependence, and the absolute value trimming function is thereby obtained.

For example, the reference voltage generating circuit 1 can be used as a battery monitoring IC of a battery incorporated in hybrid automobile, electric automobile, or the like. This battery could include multiple battery cells connected in series. An analog-to-digital (ADC) converter is provided at the output of each battery cell. When the ADC converter output voltage is measured using the reference voltage generating circuit 1, the reference voltage Vout generated by the reference voltage generating circuit 1 can be used as a measurement reference. Cell voltage can thus be obtained with high accuracy.

Second Embodiment

In the first embodiment, the mirror current Icorr for the temperature dependence is generated by the constant current sources 10 and 11. In the following, a detailed method for generating the mirror current Icorr will be explained.

Figure 5:
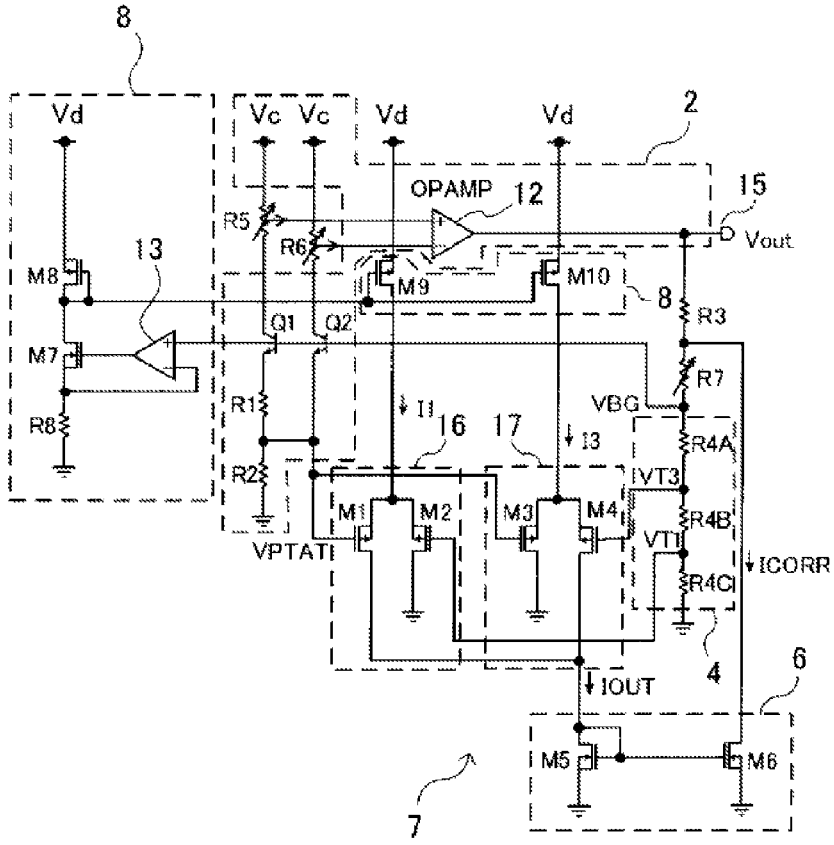
FIG. 5 is a circuit diagram of the reference voltage generating circuit according to a second embodiment.

FIG. 5 shows a circuit diagram of a reference voltage generating circuit 7 according to the second embodiment. The parts which are substantially the same in the embodiments are represented by the same symbols and will not be explained again. The reference voltage generating circuit 7 has a self-bias circuit 8 for generating current that acts as the current source of mirror current Icorr based on voltage VBG.

The self-bias circuit 8 is equipped with a resistor R8, transistors M7, M8, M9, M10, and an operational amplifier 13. The voltage VBG and the voltage at one end of the resistor R8 are applied to the operational amplifier 13, which outputs a voltage corresponding to the biased band gap voltage. The transistor M7 (first transistor) has its gate self-biased by the output of the operational amplifier 13. The transistor M8 (second transistor) has its gate self-biased by the drain of the transistor M7. The transistor M9 (third transistor) and the transistor M10 (fourth transistor) are commonly driven by the drain of the transistor M8 to act on the low-temperature region temperature compensating circuit 16 and the high-temperature region temperature compensating circuit 17. The transistors M7, M8, M9, M10 operate with the band gap voltage as the voltage reference. Here, MOS transistors are used for the transistors M7 to M10.

In the reference voltage generating circuit 7 having the configuration, the current generated by the transistors M7 and M8 in the self-bias circuit 8 is returned by the transistor M9 and flows into the differential transistor pair M1 and M2 for low-temperature correction. The self-bias circuit 8 also returns the same current by the transistor M10 and it flows to the differential transistor pair M3 and M4 for high-temperature correction. That is, a current having temperature dependence based on the temperature dependence of the voltage VBG is supplied from the self-bias circuit 8 to the low-temperature region temperature compensating circuit 16 and the high-temperature region temperature compensating circuit 17.

A DC power supply voltage Vd is applied to the sources of the transistors M9 and M10. The transistor M9 is driven by the current returned from the transistor M8 to generate a current I1 that flows to the differential transistor pair M1 and M2. The transistor M10 is driven by the current returned from the transistor M8 to generate a current I3 that flows to the differential transistor pair M3, M4.

Since the reference voltage generating circuit 7 supplies the current generated using the band gap voltage as reference to the low-temperature region temperature compensating circuit 16 and the high-temperature region temperature compensating circuit 17, the low-temperature region temperature compensating circuit 16 and the high-temperature region temperature compensating circuit 17 can correct the temperature dependence of the reference voltage Vout with the aid of a highly accurate current. The accuracy of the value of the reference voltage Vout generated by the reference voltage generating circuit 7 is thus improved.

As described above, the reference voltage generating circuit 7 according to this embodiment can generate the currents flowing to the differential transistor pairs for high/low-temperature correction with reference to the band gap voltage. Therefore, a highly accurate current that is not significantly affected by the temperature dependence can be generated.

It is also possible to use bipolar transistors for the transistors M7 to M10. For the self-bias circuit 8, the gate terminal, drain terminal, and source terminal are substituted with base terminal, collector terminal, and emitter terminal, respectively. The transistors M7, M8, M9, M10 can also operate with reference to the band gap voltage in the same way as the example of the MOS transistors.

In the embodiment, the variable resistors R5 and R6 are provided at the two terminals on the input side of the operational amplifier 12. However, it is also possible to provide a variable resistor only at one terminal of the operational amplifier 12, and substantially the same effect as the effect explained above can be realized.

It is also possible to use volume-type variable resistors instead of the variable resistors R5 and R6 shown in FIGS. 2A and 2B. The configuration of the variable resistors R5 and R6 is an example and other configurations are contemplated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reference voltage generating circuit, comprising:

a first variable resistor connected at a first end to a power supply potential;

a second variable resistor connected at a first end to the power supply potential;

a first bipolar transistor having a collector electrode connected to a second end of the first variable resistor and an emitter electrode connected to a first end of a first resistor;

a second resistor connected at a first end to a second end of the first resistor and at a second end to a ground potential;

a second bipolar transistor having a collector electrode connected to a second end of the second variable resistor and an emitter electrode connected to the second end of the first resistor and the first end of the second resistor, a base electrode of the second bipolar transistor connected to a base electrode of the first bipolar transistor;

a first differential amplifier having a first input terminal connected to the second end of the first variable resistor and a second input terminal connected to the second end of the second variable resistor, an output terminal of the first differential amplifier supplying a reference voltage;

an output stage resistor having a first end connected to the output terminal of the first differential amplifier;

a resistance dividing circuit connected to a second end of the output stage resistor and the ground potential, the resistance dividing circuit having a connection point connected to the base electrodes of the first and second bipolar transistors;

a low-temperature region temperature compensating circuit including a second differential amplifier having a first input terminal connected to a first tap voltage from the resistance dividing circuit and a second input terminal connected to the emitter electrode of the second bipolar transistor and configured to output a first correction current;

a high-temperature region temperature compensating circuit including a third differential amplifier having a first input terminal connected to a second tap voltage from the resistance dividing circuit and a second input terminal connected to the emitter electrode of the second bipolar transistor and configured to output a second correction current; and a current mirror circuit configured to output a mirror current based on the first and second correction currents to the second end of the output stage resistor, wherein the first and second bipolar transistors have a different emitter current density.

2. The reference voltage generating circuit of claim 1, further comprising:

a first constant current source connected to the low-temperature region temperature compensation circuit; and a second constant current source connected to the high-temperature region temperature compensation circuit.

3. The reference voltage generating circuit of claim 1, further comprising:

a third variable resistor connected between the output stage resistor and the resistance dividing circuit.

4. The reference voltage generating circuit of claim 1, further comprising:

a self-bias circuit connected to the base electrodes of the first and second bipolar transistors and configured to output a first constant current to the low-temperature region temperature compensation circuit and a second constant current to the high-temperature region temperature compensation circuit.

5. The reference voltage generating circuit of claim 4, wherein the base electrodes of the first and second bipolar transistors output a band gap voltage, and the self-bias circuit includes:

a first transistor having a gate or a base self-biased by the band gap voltage;

a second transistor having a gate or a base self-biased by a drain or a collector of the first transistor, a third transistor with a gate or a base connected to a source or a emitter of the second transistor, the third transistor configured to supply the first constant current; and a fourth transistor with a gate or a base connected to the source or the emitter of the second transistor, the fourth transistor configured to supply the second constant current.

6. The reference voltage generating circuit of claim 4, further comprising:

a third variable resistor connected between the output stage resistor and the resistance dividing circuit.

7. The reference voltage generating circuit of claim 5, wherein at least one of the first transistor, the second transistor, the third transistor, and the fourth transistor is a bipolar transistor.

8. The reference voltage generating circuit of claim 1, wherein at least one of the first variable resistor and the second variable resistor comprises a plurality of resistors connected in series.

9. The reference voltage generating circuit of claim 1, wherein the resistance dividing circuit comprises three resistors connected in series with a voltage tap between each connected resistor pair.

10. The reference voltage generating circuit of claim 1, wherein the first variable resistor has a resistance value that was set after a temperature dependence of the reference voltage was measured.

11. The reference voltage generating circuit of claim 1, wherein the second variable resistor has a resistance value that was set after a temperature dependence of the reference voltage was measured.

12. A circuit for monitoring a battery, comprising:

a first variable resistor connected at a first end to a power supply potential;

a second variable resistor connected at a first end to the power supply potential;

a first bipolar transistor having a collector electrode connected to a second end of the first variable resistor and an emitter electrode connected to a first end of a first resistor;

a second resistor connected at a first end to a second end of the first resistor and at a second end to a ground potential;

a second bipolar transistor having a collector electrode connected to a second end of the second variable resistor and an emitter electrode connected to the second end of the first resistor and the first end of the second resistor, a base electrode of the second bipolar transistor connected to a base electrode of the first bipolar transistor;

a first differential amplifier having a first input terminal connected to the second end of the first variable resistor and a second input terminal connected to the second end of the second variable resistor, an output terminal of the first differential amplifier supplying a reference voltage;

an output stage resistor having a first end connected to the output terminal of the first differential amplifier;

a resistance dividing circuit connected to a second end of the output stage resistor and the ground potential, the resistance dividing circuit having a connection point connected to the base electrodes of the first and second bipolar transistors;

a low-temperature region temperature compensating circuit including a second differential amplifier having a first input terminal connected to a first tap voltage from the resistance dividing circuit and a second input terminal connected to the emitter electrode of the second bipolar transistor and configured to output a first correction current;

a high-temperature region temperature compensating circuit including a third differential amplifier having a first input terminal connected to a second tap voltage from the resistance dividing circuit and a second input terminal connected to the emitter electrode of the second bipolar transistor and configured to output a second correction current;

a third variable resistor connected between the output stage resistor and the resistance dividing circuit; and a current mirror circuit configured to output a mirror current based on the first and second correction currents to the second end of the output stage resistor, wherein the first and second bipolar transistors have a different emitter current density.

13. The circuit for monitoring a battery of claim 12, further comprising:

a first constant current source connected to the low-temperature region temperature compensation circuit; and a second constant current source connected to the high-temperature region temperature compensation circuit.

14. The circuit for monitoring a battery of claim 12, further comprising:

a self-bias circuit connected to the base electrodes of the first and second bipolar transistors and configured to output a first constant current to the low-temperature region temperature compensation circuit and a second constant current to the high-temperature region temperature compensation circuit.

15. The circuit for monitoring a battery of claim 12, wherein the third variable resistor has a resistance value that was set after a voltage level of the reference voltage was measured.

16. A method of manufacturing a reference voltage circuit, comprising:

fabricating a circuit having a first variable resistor connected at a first end to a power supply potential; a second variable resistor connected at a first end to the power supply potential; a first bipolar transistor having a collector electrode connected to a second end of the first variable resistor and an emitter electrode connected to a first end of a first resistor; a second resistor connected at a first end to a second end of the first resistor and at a second end to a ground potential; a second bipolar transistor having a collector electrode connected to a second end of the second variable resistor and an emitter electrode connected to the second end of the first resistor and the first end of the second resistor, a base electrode of the second bipolar transistor connected to a base electrode of the first bipolar transistor; a first differential amplifier having a first input terminal connected to the second end of the first variable resistor and a second input terminal connected to the second end of the second variable resistor, an output terminal of the first differential amplifier supplying a reference voltage; an output stage resistor having a first end connected to the output terminal of the first differential amplifier; a resistance dividing circuit connected to a second end of the output stage resistor and the ground potential, the resistance dividing circuit having a connection point connected to the base electrodes of the first and second bipolar transistors; a low-temperature region temperature compensating circuit including a second differential amplifier having a first input terminal connected to a first tap voltage from the resistance dividing circuit and a second input terminal connected to the emitter electrode of the second bipolar transistor and configured to output a first correction current; a high-temperature region temperature compensating circuit including a third differential amplifier having a first input terminal connected to a second tap voltage from the resistance dividing circuit and a second input terminal connected to the emitter electrode of the second bipolar transistor and configured to output a second correction current; and a current mirror circuit configured to output a mirror current based on the first and second correction currents to the second end of the output stage resistor, wherein the first and second bipolar transistors have a different emitter current density;

measuring a temperature dependence of the reference voltage; and setting a resistance value of the first variable resistor to alter the temperature dependence of the reference voltage.

17. The method of claim 16, further comprising:

setting a resistance value of the second variable resistor to alter the temperature dependence of the reference voltage.

18. The method of claim 17, wherein setting the resistance values of the first and second variable resistors comprises:

measuring the reference voltage for several combinations of resistance values of the first and second variable resistors for a low temperature range;

measuring the reference voltage for several combinations of resistance values of the first and second variable resistors for a high temperature range; and selecting a combination of resistance values of the first and second variable resistors that minimizes a difference in measured reference voltages in the high and low temperature ranges.

19. The method of claim of claim 17, further comprising:

adjusting the resistance value of the first or second variable resistor to adjust a curvature of the temperature dependence of the reference voltage.

20. The method of claim 16, wherein the circuit includes a third variable resistor connected between the output stage resistor and the resistance dividing circuit, the method further comprising:

measuring a voltage level of the reference voltage; and setting a resistance value of the third variable resistor to alter the voltage level of the reference voltage.

* * * * *